United States Patent [19]

Kato et al.

[11] Patent Number: 4,936,132

[45] Date of Patent: Jun. 26, 1990

[54] CONTINUOUS HOT ROLLING PROCESS FOR MAKING THIN STEEL STRIP

[75] Inventors: Katsuhiro Kato; Tetsuya Nakamuta; Satoshi Shimazu; Hiroyuki Nitta, all of Himeji, Japan

[73] Assignee: Nippon Steel Corporation, Tokyo, Japan

[21] Appl. No.: 180,785

[22] Filed: Apr. 12, 1988

[30] Foreign Application Priority Data

Apr. 20, 1987 [JP] Japan ..... 62-95065

[51] Int. Cl.[5] ..... B21B 31/20

[52] U.S. Cl. ..... 72/240; 72/13; 72/16

[58] Field of Search ..... 72/13, 16, 240

[56] References Cited

U.S. PATENT DOCUMENTS

| | | | |
|---|---|---|---|
| 3,762,195 | 10/1973 | Kitanosono et al. | 72/240 |
| 4,593,551 | 6/1986 | Otto, Jr. et al. | 72/240 |
| 4,608,850 | 9/1986 | Ballantyne et al. | 72/240 |
| 4,614,098 | 9/1986 | Kotera | 72/240 |

FOREIGN PATENT DOCUMENTS

| | | |
|---|---|---|
| 56-33119 | of 0000 | Japan . |
| 46-31442 | 9/1971 | Japan . |
| 50-7762 | 1/1975 | Japan . |
| 52-15254 | 4/1977 | Japan . |

*Primary Examiner*—W. Donald Bray

*Attorney, Agent, or Firm*—Cushman, Darby & Cushman

[57] ABSTRACT

This invention provides a continuous hot rolling process for making thin strip in which it is possible to roll strips at high rolling speeds required to keep a finisher delivery temperature equal to or higher than an $Ar_3$ transformation temperature. The gist of the present invention resides in a continuous hot rolling process in which the rolling speed of a final finishing mill is kept constant or slightly increased until the leading end of rolled strip travels from the final finishing mill to a down coiler which process comprises: rolling a predetermined length of the leading end portion of a stock being rolled in accordance with a strip thickness greater than a finished thickness; then reducing the strip thickness to the finished thickness by gauge alteration in rolling; and subsequently rolling the following portion.

3 Claims, 4 Drawing Sheets

FLOW CHART OF GAUGE ALTERATION CONTROL IN ROLLING

CONTINUOUS HOT ROLLING PROCESS FOR MAKING THIN STEEL STRIP

BACKGROUND OF THE INVENTION

1. Field of the Invention

The present invention relates to a continuous hot rolling process for making thin steel strip.

2. Description of the Prior Art

In recent years, hot rolled sheets have been used in place of cold rolled sheets from the viewpoint of cost savings and, particularly recently, there has been a demand for hot rolled sheet having good formability.

In general, to impart good formability to hot rolled sheets, it is necessary that the temperature of the hot strip immediately after finish rolling is completed (hereinafter referred to as "finisher delivery temperature") should be kept equal to or higher than the $Ar_3$ transformation temperatures. However, in the case of thin strip having an extremely small (gauge) thickness (a thickness of typically 0.8 to 1.2 mm), it is difficult to realize a finisher delivery temperature sufficiently high to achieve the desired formability of such thin strip since a great temperature drop occurs during finish rolling and high rolling speeds cannot be obtained.

The reason why thin strip cannot be rolled at high rolling speeds is that the phenomenon of "waddling" occurs on a hot-run table, and, worst of all, it becomes impossible to continue rolling. "Waddling" is a phenomenon in which a strip cannot run smoothly in rolling. The reason for this is that the strip waves or is irregularly contracted in width or is partly bulged. The waddling phenomenon is well known in the art. For this reason, in a conventional rolling process, a hot strip is rolled at a low speed called threading speed such that no waddling occurs until the leading head of a hot strip reaches a coiler and, after the strip head has reached the coiler, the rolling speed is increased. However, in such a conventional rolling process, as the thickness of hot strip becomes smaller, it is necessary to correspondingly reduce the threading speed at which the head of a hot strip is rolled, with the result that the leading end portion of the hot strip is not overheated and at the same time a portion following the leading strip head is also cooled. It is therefore impossible to maintain a finisher delivery temperature necessary for imparting good formability to the aforesaid thin hot strip over a significant length thereof.

To solve the above-described problem, Japanese Patent Examined Publication No. 52-15254 proposes a rolling process comprising the steps of rolling the head of a hot strip at high speed, then reducing the rolling speed of a finishing mill during the period from the moment at which the head of the thus-rolled hot strip passes through the final finishing mill to the moment at which the strip head reaches a coiler and subsequently increasing the rolling speed. This is a method of utilizing the inertia of the strip head created by high speed rolling to eliminate waddling by speed reduction, but involves the disadvantage that, since strip temperature lowers during speed reduction, the finisher delivery temperature obtained when the strip head reaches the coiler becomes lower than a desired temperature. Therefore, according to the past level of techniques, it has been extremely difficult to maintain a finisher delivery temperature sufficiently high to impart desired formability to thin strip having an extremely small thickness.

SUMMARY OF THE INVENTION

It is therefore an object of the present invention to provide a continuous hot-rolling process for making thin strip in which a temperature drop in the hot strip can be prevented by performing rolling either without reducing the rolling speed of a finishing mill or while maintaining the high rolling speed of the rolling mill by minimizing the degree of speed reduction.

To achieve the above objects, the present invention has been accomplished by various researches, and the gist of the present invention resides in the following three aspects.

In accordance with a first aspect of the present invention, a continuous hot rolling process for making thin strip comprises the steps of:

rolling a predetermined length of the leading end portion of a stock being rolled at high speeds in accordance with a strip thickness, which eliminates any waddling even at a high threading speed enabling ensuring the $Ar_3$ transformation temperature, in case a finished thickness is small such that waddling is produced on the leading end portion of the strip to make it impossible to utilize an appropriate threading speed and to ensure a finisher delivery temperature not lower than the $Ar_3$ transformation temperature of said strip, and subsequently rolling the subsequent portion of said stock at the same speed as in said leading end portion of said stock in accordance with a finished thickness while effecting gage alteration in rolling.

In a second aspect of the present invention, another improvement is provided in a continuous hot rolling process according to the first aspect of the present invention, the improvement wherein said finished thickness of the thin strip is in the range of 0.8 to 1.0 mm.

In a third aspect to the present invention, further improvement is provided in a continuous hot rolling process according to the first aspect of the present invention, the improvement wherein said thin strip is a low carbon steel.

Prior to the description of the present invention, theoretical consideration will be given to the "waddling phenomenon". The waddling phenomenon occurs by the following primary causes (1) Flotation of the leading end of a strip by the action of a lifting force While a strip is traveling at high speed, its strip head floats due to collision with a hot run table roller, and is lifted by a lifting force generated by a combination of wind pressure and the resistance of strip cooling water. As a result, the travel of the leading head is delayed, and this leads to the occurrence of the waddling phenomenon in the strip.

(2) Deflection of a traveling strip between hot-run table rollers

While a strip is traveling over a hot-run table, the strip deflects between hot-run table rollers since it is not a completely rigid object. As a result, deflection accumulates in the portion of the strip between its leading end and a final finishing mill, and this develops into the waddling phenomenon of the strip autonomously.

Since the waddling phenomenon occurs by the above-described two mechanisms, the extent of waddling greatly depends upon the thickness of a strip. More specifically, when thin strip having an extremely small thickness travels, the flotation phenomenon described in the above paragraph (1) is liable to occur since the leading end portion of such thin strip has low rigidity and light weight, and in addition, the deflection of the thin strip increases between the hot run table rollers. As a result, the waddling phenomenon occurs extremely easily. Also, the waddling phenomenon is intimately related to the speed of strip travel and, as the travel speed is higher, the waddling phenomenon occurs more easily. Accordingly, in order to roll the leading head of the strip, it is necessary to cause the strip to travel at a reduced speed, and this leads to a temperature drop in the strip.

In the first aspect of the present invention, the continuous hot finish rolling of each kind of thin strip is conducted at high speed at which it is possible to keep a finisher delivery temperature of the thin strip equal to or higher than the $Ar_3$ transformation temperature determined according to the material of the strip.

In this case, a predetermined length of the leading end portion of stock is rolled to a strip thickness greater than the finished thickness of thin strip, and the thus-rolled portion is used as an anti-waddling leader portion. It is obvious from the above theoretical consideration as to the "waddling phenomenon" that formation of the anti-waddling leader portion can effectively prevent the waddling of thin strip. This anti-waddling leader portion is rolled at the above-described high speed at which it is possible to keep the finisher delivery temperature of the thin strip equal to or higher than the $Ar_3$ transformation temperature of each kind of thin strip, and the rolled anti-waddling leader portion is made to travel over the hot run table without waddling After a predetermined length of anti-waddling leader portion has been rolled, strip thickness is reduced to the finished thickness of the thin strip by altering gauges in rolling, and then the hot strip that follows the anti-waddling leader portion is rolled.

In the prior art, rolling speed cannot be sufficiently increased since the waddling phenomenon easily occurs at high rolling speeds, and it has therefore been impossible to keep a finisher delivery temperature equal to or higher than an $Ar_3$ transformation temperature. However, in accordance with the first aspect of the present invention, the finisher delivery temperatures of such thin strip can be maintained and thus good formability can be realized.

In addition, the anti-waddling leader portion is available for order articles having a predetermined length and a large thickness. More specifically, when a small lot of article having a larger thickness and a substantially smaller length than those of a coil is ordered, it is possible to manufacture a hot coil including an anti-waddling leader portion available for the ordered article and a succeeding product of an extremely small thickness, which leader portion and product are wound together as one coil.

DESCRIPTION OF THE PREFERRED EMBODIMENTS

The present invention will be described in detail below with reference to the accompanying drawings.

Figure 1:
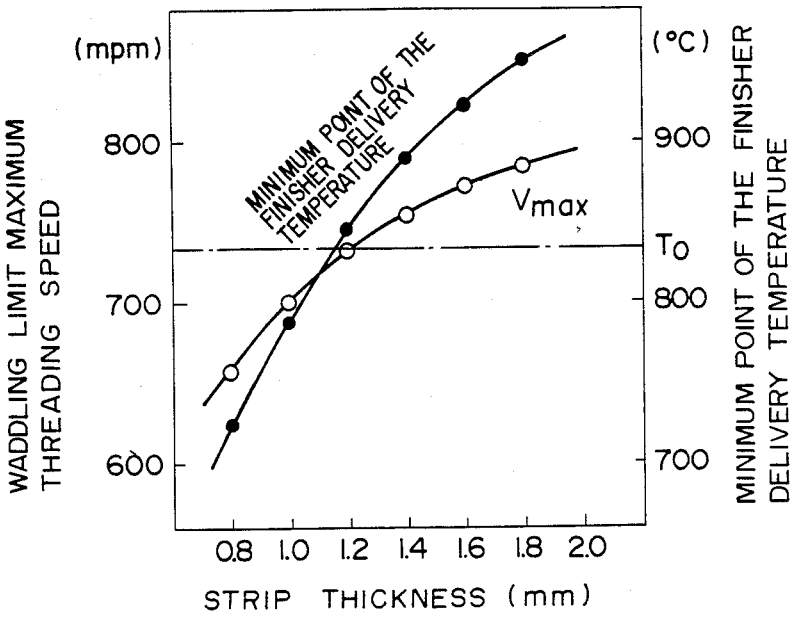
FIG. 1 (PRIOR ART)
FIG. 1 is a graph showing a "waddling limit maximum threading speed" and a "minimum point of the finisher delivery temperature" for each strip thickness when a strip is rolled by a conventional rolling process which comprises the steps of rolling at a low threading speed during the period the moment at which the leading end of the strip passes through a final finishing mill to the moment at which the leading end reaches a down coiler; and subsequently increasing the rolling speed of the finishing mill.

FIG. 1 is a graph showing a waddling limit maximum threading speed $V_{max}$ and the corresponding minimum point of the finisher delivery temperature for each strip thickness when a 1 m wide hot strip of common steel is rolled by a conventional rolling process which comprises effecting low speed rolling during the period from the moment at which the leading end of the rolled strip passes through a final finishing mill to the moment at which the leading end reaches a down coiler, and subsequently increasing the rolling speed (the waddling maximum limit threading speed herein means the upper limit of a speed at which the leading end portion of a rolled strip can travel without waddling over a hot run table following the final finishing mill).

As can be seen from FIG. 1, in the conventional rolling, a finisher delivery temperatures $T_o$ (*about* 830° C.) required for achieving good formability is maintained with respect to strips 1.2 mm thick or more, but not with respect to strips 0.8 to 1.0 mm thick.

The strips 0.8 to 1.0 mm thick are so-called extremely thin hot-rolled strips which are the most difficult to manufacture in the level of the current techniques.

Figure 2:
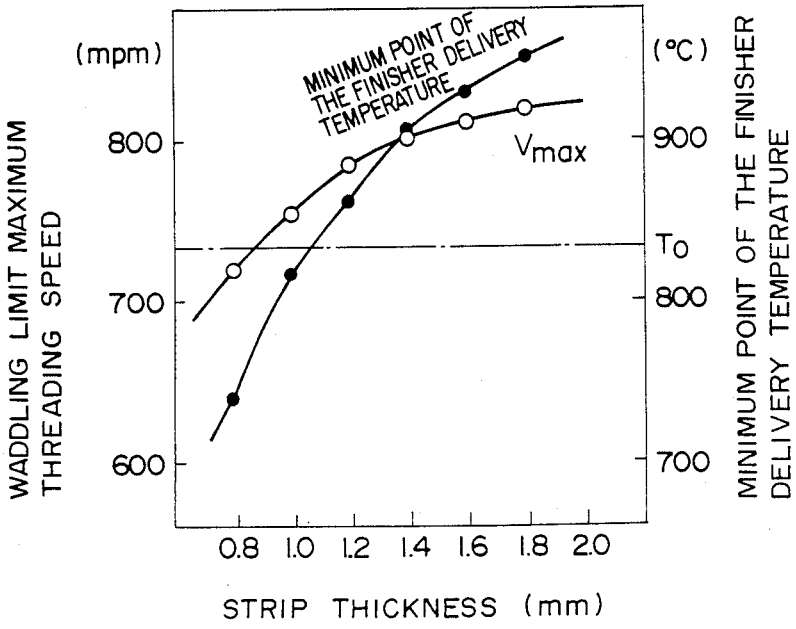
FIG. 2 (PRIOR ART)
FIG. 2 is a graph showing a "waddling limit maximum threading speed" and a "minimum point of the finisher delivery temperature" for each strip thickness when a strip is rolled by another conventional rolling process which comprises the steps of rolling the leading end portion of the strip at high speeds, then reducing the rolling speed of a finishing mill during the period from the moment at which the leading end of the strip passes through the final finishing mill to the moment at which the leading end reaches a down coiler, and subsequently increasing the rolling speed of the finishing mill.

FIG. 2 is a graph showing the waddling limit maximum threading speed $V_{max}$ and the corresponding minimum point of the finisher delivery temperature for each strip thickness when the 1 m wide strip is rolled by another conventional rolling process which comprises rolling the leading end portion of the strip at high speeds, then reducing the rolling speed of a finishing mill at a speed-reduction ratio of 9 mpm/sec. during the period from the moment at which the leading end of the rolled strip passes through the final finishing mill to the moment at which the leading end reaches a down coiler, and subsequently increasing the rolling speed. If the ratio of speed reduction is increased, $V_{max}$ can be increased, but the finisher delivery temperature is rather lowered because of the increased ratio of speed reduction. Therefore, the minimum point of the finisher delivery temperature is not greatly improved.

As can be seen from FIG. 2, in this conventional rolling as well, the finisher delivery temperature $T_D$ (about 830° C.) required for achieving good formability is not maintained with respect to the strips 0.8 to 1.0 mm thick.

The present invention provides a useful process in which thin strip such as strips 0.8 to 1.0 mm thick which are the most difficult to manufacture by hot rolling as described above can be rolled at a finisher delivery temperature (equal to or higher than an $Ar_3$ transformation temperature) at which the good formability of the thin strip is maintained across its overall length. An example in which the present invention is carried out will be described below with reference to the first aspect of this invention by way of example.

Figure 3:
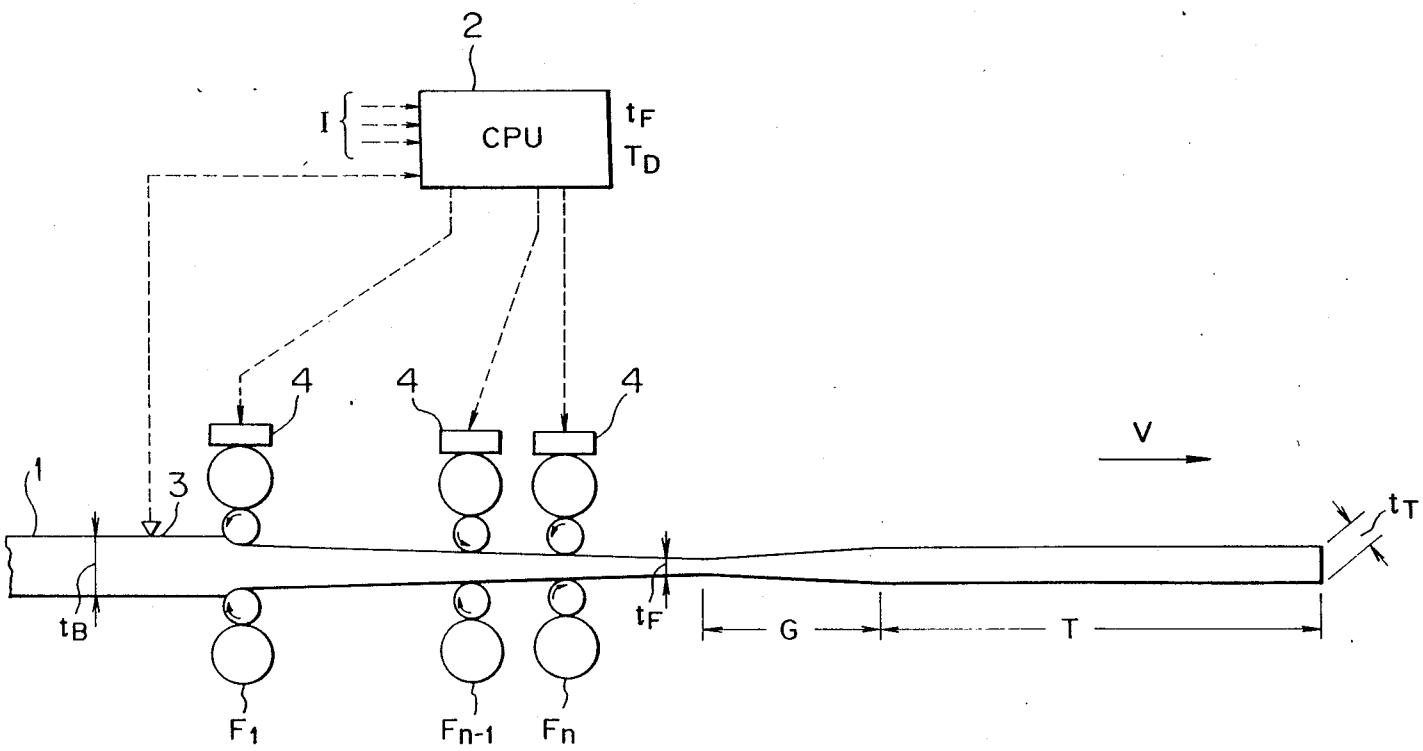
FIG. 3 is a schematic illustration of a typical example of a manner wherein the present invention is carried out.
Figure 4:
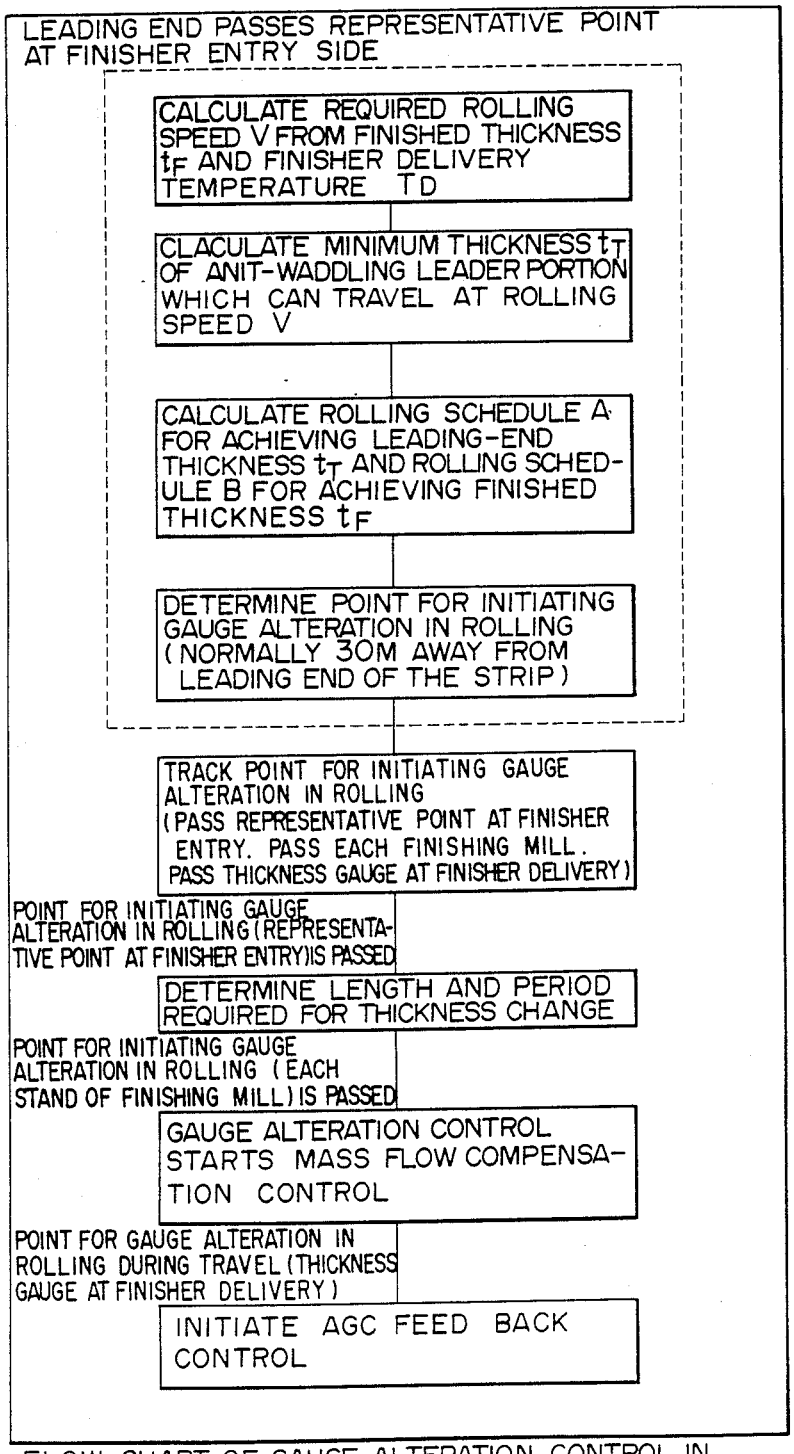
FIG. 4 is a flow chart illustrating gauge alteration control in rolling in the present invention.

FIG. 3 illustrates the relationships between finishing mills $F_1$ to $F_n$, hot strip being rolled, and a control computer (CPU), but finishing mills $F_2$ to $F_n$ are not shown for the sake of clarity. FIG. 4 is a flow chart illustrating the control of gauge alteration in rolling.

A stock (bar) 1 which has been roughly rolled is conveyed toward the finished mill $F_1$ over a roller table (not shown). A CPU 2 previously stores information I relative to a thickness $t_B$, material, temperature and the like of the stock 1 to be rolled, as well as a finished thickness $t_F$ and a desired finisher delivery temperature $T_D$. The CPU 2 first computes a rolling speed V (the rolling speed of the finishing mill $F_n$) required for maintaining finisher delivery temperature $T_D$ for the finished thickness $t_F$, and then computes the minimum strip thickness $t_T$ of an anti-waddling leader portion which is allowed to travel without waddling over a hot run table at the rolling speed V.

The CPU 2 normally monitors the position of the leading end of the stock 1 to be rolled and the position of the trailing end of the anti-waddling leader portion (the leading end of a command thickness portion to be rolled to a desired sheet thickness), and exerts the following gauge alteration control in rolling in accordance with the result of monitoring.

First, when it has been detected that the leading end of the stock 1 has reached a predetermined position ahead of the finishing mill $F_1$, the CPU 2 computes a rolling schedule A for rolling the anti-waddling leader portion to the strip thickness $t_T$, and initiates the rolling of the leading end portion in accordance with the rolling schedule A. Simultaneously, the CPU 2 computes a rolling schedule B for the stand of each of the finishing mills so as to roll the common thickness portion to the finished thickness $t_F$.

When it has been detected that the trailing end of the anti-waddling leader portion has reached each of the finishing mills, the position of the screw-down device of the corresponding stand is moved in accordance with the rolling schedule B computed previously. This operation is repeated until the trailing end of the anti-waddling leader portion passes through the stand of the finishing mill $F_n$, thereby altering gauges in rolling so that the finishing thickness $t_F$ can be obtained.

When the rolling schedule is changed at each stand, the turbulence of a mass flow occurs between adjacent stands. However, the CPU 2 predicts the turbulence and feeds foward the prediction to speed control, thereby achieving a smooth alteration in strip thickness. As the strip thickness $t_T$ of the anti-waddling leader portion is increased, a greater anti-waddling effect can be obtained. However, a great loss is involved because of an extended length of a portion G the thickness of which is gradually varied by gauge alteration in rolling, and moreover it becomes difficult to exert control over the gauge alteration in rolling. Accordingly, it is preferable to select the minimum strip thickness that can achieve the above-described object. It has been confirmed through the experiments that the anti-waddling leader portion needs to be equal to or greater than 30 m long, irrespective of the finishing thickness $t_F$.

EXAMPLES

Table 1 shows rolling conditions and rolling results when a 0.8 mm thick strip is rolled by each of the rolling process of the following five cases.

Case 1: a conventional rolling process comprising the steps of effecting low speed rolling during the period from the moment at which the leading end of the strip passes through a final rolling mill to the moment at which the leading end reaches a down coiler, and then increasing the rolling speed, Case 2: a conventional rolling process comprising reducing the rolling speed of a finishing mill during the period from the moment at which the leading end of the strip passes through the final rolling mill to the moment at which the leading end reaches a down coiler, and then increasing the rolling speed, Case 3: the rolling process according to the first aspect of the present invention.

Table 2 shows rolling conditions and rolling results when a 1.2 mm thick strip is rolled by each of the rolling process of Cases 1 to 3.

Figure 5:
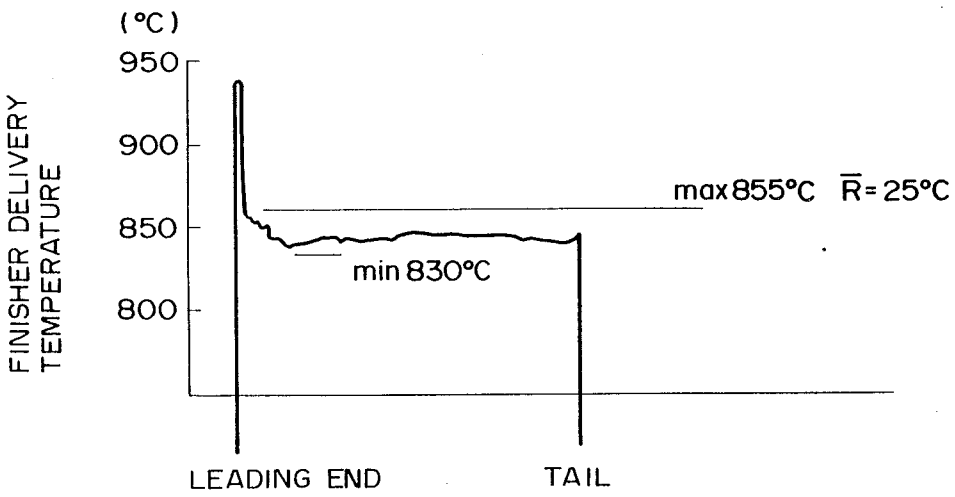
FIG. 5 is a graph showing an example of the finisher delivery temperature in the embodiment of the present invention.

FIG. 5 is a graph showing an example of finisher delivery temperature when a 0.8 mm thick strip is rolled by the rolling process according to the first aspect of the present invention.

As shown in Table 1, when the 0.8 mm thick strip is rolled by the conventional rolling processes, the ratio of passed products are about 50% at best. However, according to the processes of the present invention, almost all the rolled strips are passed except for the off-gauge portions of the leading end portions thereof, and yield is markedly improved. This holds for the hot rolling of the 1.2 mm thick low carbon strip.

The advantage of the present invention over the prior art has only been described in conjunction with the yield of the products. However, when the prior art processes are actually carried out, rolling is effected at less than an $Ar_3$ transformation temperature. Therefore, it is difficult to perform normal rolling by the prior art because of a rapid change in deformation resistance and it is virtually impossible to effect proper production. T,170 T,190

What is claimed is:

1. A continuous hot rolling process for making thin strip comprising the steps of:

storing information regarding at least a thickness $t_B$ and a temperature of a material to be rolled and a finished thickness $t_F$ and a finisher delivery temperature $T_D$;

computing a rolling speed V required for maintaining finisher delivery temperature $T_D$ for the finished thickness $t_F$;

computing a minimum strip thickness $t_T$ of an anti-waddling leader portion which can travel without waddling over a hot run table at said rolling speed V;

rolling a predetermined length of a leading end of the material to be rolled at said minimum strip thickness $t_T$; and subsequently rolling a subsequent portion of said material at said speed V at which said leading end portion of said material is rolled at a finished thickness $t_F$ while effecting gauge alteration in rolling.

2. A rolling process as in claim 1, wherein said step of storing a finished thickness $t_F$ and rolling to said finished thickness $t_F$ comprises storing and rolling to a finished thickness $t_F$ in a range of 0.8 to 1.0 mm.

3. A rolling process as set forth in claim 1, wherein said step of rolling the material comprises rolling a low carbon steel material.

* * * * *